US010465948B2

(12) United States Patent
Park et al.

(10) Patent No.: US 10,465,948 B2
(45) Date of Patent: Nov. 5, 2019

(54) AIR CONDITIONER

(71) Applicant: LG ELECTRONICS INC., Seoul (KR)

(72) Inventors: Heewoong Park, Seoul (KR); Jeongseob Shin, Seoul (KR); Noma Park, Seoul (KR); Seungtaek Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 227 days.

(21) Appl. No.: 15/267,244

(22) Filed: Sep. 16, 2016

(65) Prior Publication Data

US 2017/0074552 A1 Mar. 16, 2017

(30) Foreign Application Priority Data

Sep. 16, 2015 (KR) ..... 10-2015-0131227

(51) Int. Cl.
*F25B 49/00* (2006.01)
*F25B 13/00* (2006.01)

(52) U.S. Cl.
CPC ..... *F25B 13/00* (2013.01); *F25B 49/00* (2013.01)

(58) Field of Classification Search
CPC ... F25B 2313/0251; F25B 13/00; F25B 49/02
See application file for complete search history.

(56) References Cited

U.S. PATENT DOCUMENTS

2004/0035132 A1 2/2004 Park et al.
2006/0090487 A1* 5/2006 Park ..... F25B 13/00 62/160

FOREIGN PATENT DOCUMENTS

CN 103256748 8/2013
CN 104870905 8/2015
JP 7-120089 5/1995
JP H08-035731 2/1996

OTHER PUBLICATIONS

Korean Office Action dated Sep. 19, 2016 issued in Application No. 10-2015-0131227.
Chinese Office Action (with English translation) dated Dec. 24, 2018 issued in CN Application No. 201610828850.X.
European Search Report dated Feb. 8, 2017.

* cited by examiner

*Primary Examiner* — Ljiljana V. Ciric
*Assistant Examiner* — Alexis K Cox
(74) *Attorney, Agent, or Firm* — Ked & Associates, LLP

(57) ABSTRACT

An air conditioner that includes a compressor that compresses a refrigerant, a main outdoor heat exchanger that condenses the refrigerant in a cooling mode and that evaporates the refrigerant in a heating mode, an indoor heat exchanger that evaporates the refrigerant in the cooling mode while condensing the refrigerant in the heating mode, a switch that guides the refrigerant discharged from the compressor to the main outdoor heat exchanger in the cooling mode and that guides the refrigerant discharged from the compressor to the indoor heat exchanger in the heating mode, and a sub outdoor heat exchanger that evaporates a portion of the refrigerant condensed in the main outdoor heat exchanger in a low-load cooling mode and that condenses a portion of the refrigerant discharged from the compressor in a low-load heating mode.

2 Claims, 4 Drawing Sheets

AIR CONDITIONER

CROSS-REFERENCE TO RELATED APPLICATION(S)

This application claims priority under 35 U.S.C. § 119 to Korean Application No. 10-2015-0131227, filed in Korea, on Sep. 16, 2015, whose entire disclosure is hereby incorporated by reference.

BACKGROUND

1. Field

An air conditioner is disclosed herein.

2. Background

Generally, an air conditioner is an apparatus that cools or heats an indoor space, using a refrigeration cycle including a compressor, an outdoor heat exchanger, an expansion valve, and an indoor heat exchanger. That is, such an air conditioner may include a cooler that cools an indoor space, and a heater that heats an indoor space. Alternatively, such an air conditioner may be a cooling and heating air conditioner having a function of cooling and heating an indoor space.

When such an air conditioner is a cooling and heating air conditioner, the air conditioner includes a switching unit or switch that switches a flow path of a refrigerant compressed by a compressor in accordance with cooling and heating modes. That is, in a cooling mode, the refrigerant compressed by the compressor is fed to an outdoor heat exchanger after passing through the switching unit. In this case, the outdoor heat exchanger functions as a condenser. The refrigerant, which is condensed in the outdoor heat exchanger, is introduced into an indoor heat exchanger after being expanded by an expansion valve. In this case, the indoor heat exchanger functions as an evaporator. The refrigerant which is evaporated in the indoor heat exchanger, is introduced into the compressor after again passing through the switching unit.

In a heating mode, the refrigerant compressed by the compressor is fed to the indoor heat exchanger after passing through the switching unit. In this case, the indoor heat exchanger functions as a condenser. The refrigerant, which is condensed in the indoor heat exchanger, is introduced into an outdoor heat exchanger after being expanded by the expansion valve. In this case, the outdoor heat exchanger functions as an evaporator. The refrigerant, which is evaporated in the outdoor heat exchanger, is introduced into the compressor after again passing through the switching unit.

In such an air conditioner, an inverter type compressor, which varies in operation speed in accordance with a cooling or heating load, may be utilized. However, when the cooling or heating load is as low as or lower than a load for which a minimum operation speed of the compressor is required, operation of the air conditioner may be stopped, and as such, a user may be displeased.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to embodiments, examples of which are illustrated in the accompanying drawings. However, the embodiments may be embodied in many different forms and should not be construed as limited to the embodiments set forth herein. Rather, these embodiments are provided so that this disclosure will be thorough and complete, and will fully convey the scope of the disclosure to those skilled in the art. The embodiments are defined only by the categories of the claims. Wherever possible, the same or like reference numbers will be used throughout the drawings to refer to the same or like parts.

Hereinafter, embodiments will be described with reference to the accompanying drawings explaining air conditioners according to embodiments.

Figure 1:
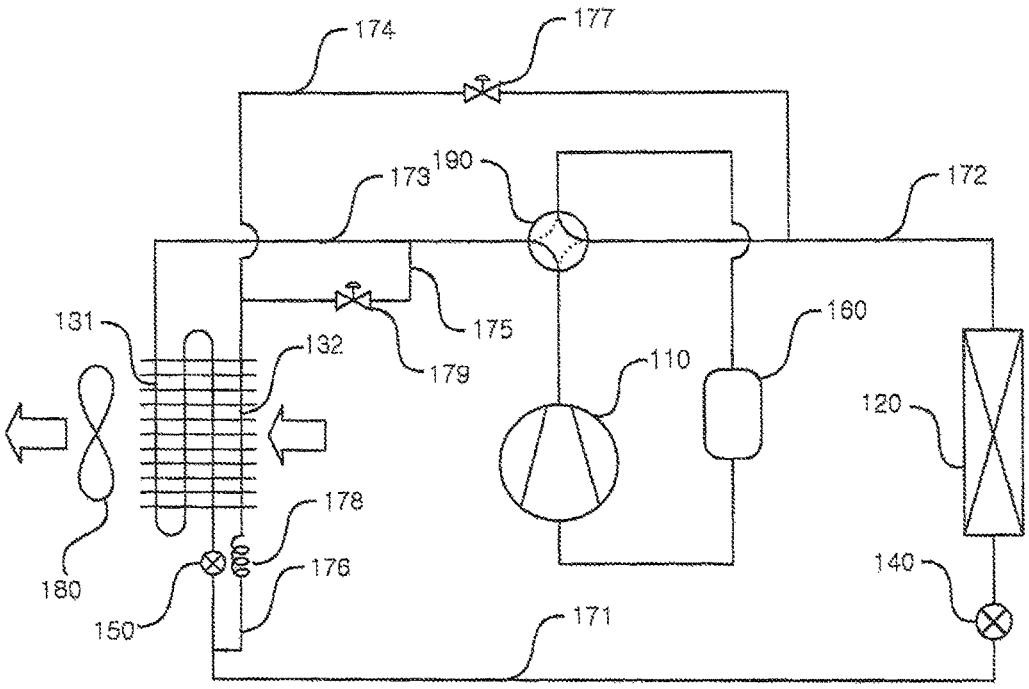
FIG. 1 is a schematic diagram of an air conditioner according to an embodiment.
Figure 2:
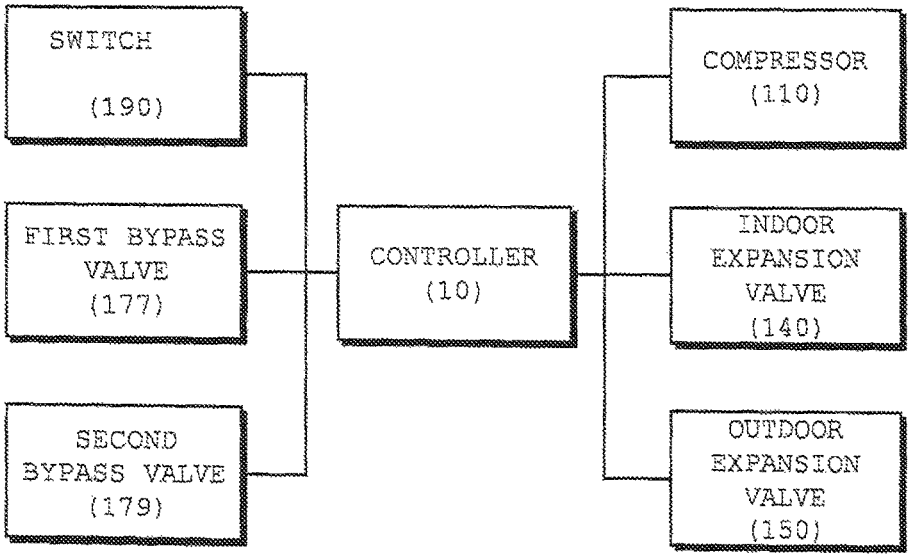
FIG. 2 is a block diagram of the air conditioner of FIG. 1.

FIG. 1 is a schematic diagram of an air conditioner according to an embodiment. FIG. 2 is a block diagram of the air conditioner of FIG. 1.

The air conditioner according to an embodiment may include a compressor 110 that compresses a refrigerant, a main outdoor heat exchanger 131 installed or provided in an outdoor space, to perform heat exchange between outdoor air and the refrigerant, and an indoor heat exchanger 120 installed or provided in an indoor space, to perform heat exchange between indoor air and the refrigerant. The air conditioner may further include a switching unit or switch 190 that guides the refrigerant discharged from the compressor 110 to the main outdoor heat exchanger 131 in a cooling mode while guiding the refrigerant discharged from the compressor 110 to the indoor heat exchanger 120 in a heating mode, and a sub outdoor heat exchanger 132 connected, at one or a first end thereof, between the main outdoor heat exchanger 131 and the indoor heat exchanger 120 while being connected, at the other or a second end thereof, between the switch 190 and the indoor heat exchanger 120, to perform heat exchange between outdoor air and the refrigerant.

The compressor 110 may compress low-temperature and low-pressure refrigerant introduced thereinto into high-temperature and high-pressure refrigerant. Various structures may be applied as the compressor 110. For example, the compressor 110 may be a reciprocating compressor using a cylinder and a piston or a scroll compressor using an orbiting scroll and a fixed scroll. In this embodiment, the compressor 110 is a scroll compressor. A plurality of compressors 110 may be provided.

In the cooling mode, refrigerant evaporated in the indoor heat exchanger 120 may be introduced into the compressor 110. In the heating mode, refrigerant evaporated in the main outdoor heat exchanger 131 may be introduced into the compressor 110.

In this embodiment, the cooling mode is an operation mode for expanding refrigerant in the indoor heat exchanger 120, to cool indoor air. The heating mode may be an operation mode for condensing refrigerant in the indoor heat exchanger 120, to heat indoor air. The cooling mode may be classified into a general cooling mode, a low-load cooling mode for a low cooling load, and a high-load cooling mode for a high cooling load. The heating mode may be classified into a general heating mode, a low-load heating mode for a low heating load, and a high-load heating mode for a high heating load.

The cooling or heating load is a requested cooling or heating level. Generally, the cooling or heating load is determined based on a difference between an indoor temperature and a set or predetermined temperature. When the set or predetermined temperature is excessively lower than the indoor temperature in the cooling mode, the cooling load is determined as a high load. When the difference between the indoor temperature and the set or predetermined temperature is small in the cooling mode, the cooling load is determined as a low load. On the other hand, when the set or predetermined temperature is excessively higher than the indoor temperature in the heating mode, the heating load is determined as a high load. When the difference between the indoor temperature and the set or predetermined temperature in the heating mode is small, the heating load is determined as a low load.

A gas-liquid separator 160 may be provided to separate gas-phase refrigerant and liquid-phase refrigerant from refrigerant introduced from the compressor 110. The gas-liquid separator 160 may be connected between the compressor 110 and the switch 190. The gas-liquid separator 160 may separate gas-phase refrigerant and liquid-phase refrigerant from refrigerant evaporated in the indoor heat exchanger 120, main outdoor heat exchanger 131, and/or sub outdoor heat exchanger 132. The gas-phase refrigerant separated by the gas-liquid separator 160 may be introduced into the compressor 110.

The switch 190 may be a path switching valve that switches between cooling and heating. In the cooling mode, the switch 190 may guide the refrigerant to the main outdoor heat exchanger 131. In the heating mode, the switch 190 may guide the refrigerant to the indoor heat exchanger 120. The switch 190 may be connected to the compressor 110, the gas-liquid separator 160, a first gas line 172, and a second gas line 173.

In the cooling mode, the switch 90 may connect the compressor 110 to the second gas line 173 while connecting the gas-liquid separator 160 to the first gas line 172. In the heating mode the switch 190 may connect the compressor 110 to the first gas line 172 while connecting the gas-liquid separator 160 to the second gas line 173.

The switch 190 may be implemented using various modules capable of connecting different paths. In this embodiment, the switch 190 is shown as a 4-way valve. Of course, the switch 190 may be implemented using a combination of two 3-way valves, various other valves, or a combination thereof, for example.

The indoor heat exchanger 120 may be installed or provided in the indoor space, to perform heat exchange between indoor air and the refrigerant. The indoor heat exchanger 120 may evaporate the refrigerant in the cooling mode while condensing the refrigerant in the heating mode.

The indoor heat exchanger 120 may be connected to the switch 190 via the first gas line 172 while being connected to an indoor expansion valve 140. In the cooling mode, refrigerant expanded by the indoor expansion valve 140 may be introduced into the indoor heat exchanger 120, and fed to the switch 190 via the first gas line 172 after being evaporated in the indoor heat exchanger 120. In the heating mode, the refrigerant emerging from the switch 190 after being compressed in the compressor 110 may be introduced into the indoor heat exchanger 120 via the first gas line 172 and then fed to the indoor expansion valve 140 after being condensed in the indoor heat exchanger 120.

In the cooling mode, an opening degree of the indoor expansion valve 140 may be adjusted, and the refrigerant expanded through adjustment of the opening degree. On the other hand, in the heating mode, the indoor expansion valve 140 may be completely opened to allow refrigerant to pass therethrough. The indoor expansion valve 140 may be connected to the indoor heat exchanger 120 and a liquid line 171.

In the cooling mode, the indoor expansion valve 140 may expand refrigerant fed to the indoor heat exchanger 120 via the liquid line 171. In the heating mode, the indoor expansion valve 140 may guide the refrigerant introduced from the indoor heat exchanger 120 to the liquid line 171.

The main outdoor heat exchanger 131 may be installed or provided in the outdoor space, to perform heat exchange between outdoor air and the refrigerant. The main outdoor heat exchanger 131 may condense the refrigerant in the cooling mode while evaporating the refrigerant in the heating mode.

The main outdoor heat exchanger 131 may be connected to the second gas line 173 via the switch 190 while being connected to an outdoor expansion valve 150. In the cooling mode, refrigerant emerging from the switch 190 after being compressed in the compressor 110 may be introduced into the main outdoor heat exchanger 131 via the second gas line 173, and then fed to the outdoor expansion valve 150 after being condensed in the main outdoor heat exchanger 131. In the heating mode, refrigerant expanded by the outdoor expansion valve 150 may be introduced into the main outdoor heat exchanger 131, and then fed to the switch 190 via the second gas line 173 after being evaporated in the main outdoor heat exchanger 131.

In the cooling mode, the outdoor expansion valve 150 may be completely opened to allow refrigerant to pass therethrough. On the other hand, in the heating mode, an opening degree of the outdoor expansion valve 150 may be adjusted, and the refrigerant may be expanded through adjustment of the opening degree. The outdoor expansion valve 150 may be connected to the main outdoor heat exchanger 131 and the liquid line 171.

In the cooling mode, the outdoor expansion valve 150 may guide the refrigerant emerging from the main outdoor heat exchanger 131 to the liquid line 171. In the heating mode, the outdoor expansion valve 150 may expand the refrigerant flowing toward the main outdoor heat exchanger 131 via the liquid line 171.

The sub outdoor heat exchanger 132 may be installed or provided in the outdoor space in accordance with a load, to perform heat exchange between outdoor air and the refrigerant. The sub outdoor heat exchanger 132 may be connected to a liquid branch line 176, a first bypass line 174, and a second bypass line 175. The sub outdoor heat exchanger 132 may be connected, at one or a first end thereof, between the main outdoor heat exchanger 131 and the indoor heat exchanger 120 while being connected, at the other or a second end thereof, between the switch 190 and the indoor heat exchanger 120. In addition, the second end of the sub outdoor heat exchanger 132 may be connected between the switch 190 and the main outdoor heat exchanger 131.

In the general cooling mode or general heating mode, the sub outdoor heat exchanger 132 does not operate, and as such, does not perform heat exchange between outdoor air and the refrigerant. In the low-load cooling mode or high-load heating mode, the sub outdoor heat exchanger 132 evaporates the refrigerant. In the love-load heating mode or high-load cooling mode, the sub outdoor heat exchanger 132 condenses the refrigerant.

In the low-load cooling mode, a portion of refrigerant introduced into the liquid line 171 via the outdoor expansion valve 150 after being condensed in the main outdoor heat exchanger 131 may be introduced into the sub outdoor heat exchanger 132 via the liquid branch line 176, and then evaporated in the sub outdoor heat exchanger 132. The evaporated refrigerant may be joined with refrigerant evaporated by the indoor heat exchanger 120 via the first bypass line 174, and then fed to the switch 190.

In the high-load cooling mode, a portion of refrigerant introduced into the second gas line 173 via the switch 190 after being compressed in the compressor 110 may be introduced into the sub outdoor heat exchanger 132 via the second bypass line 175, and then condensed in the sub outdoor heat exchanger 132. The condensed refrigerant may be joined with refrigerant condensed in the main outdoor heat exchanger 131 via the liquid branch line 176, and then fed to the liquid line 171.

In the low-load heating mode, a portion of refrigerant introduced into the first gas line 172 via the switch 190 after being compressed in the compressor 110 may be introduced into the sub outdoor heat exchanger 132 via the first bypass line 174, and then condensed in the sub outdoor heat exchanger 132. The condensed refrigerant may be joined with refrigerant condensed in the indoor heat exchanger 120 via the liquid branch line 176, and then fed to the liquid line 171.

In the high-load heating mode, a portion of refrigerant introduced into the liquid line 171 via the indoor expansion valve 140 after being condensed in the indoor heat exchanger 120 may be introduced into the sub outdoor heat exchanger 132 via the liquid branch line 176, and then evaporated in the sub outdoor heat exchanger 132. The evaporated refrigerant may be joined with refrigerant evaporated in the main outdoor heat exchanger 131 via the second bypass line 175, and then fed to the switch 190.

The liquid line 171 may be connected to the outdoor expansion valve 150 and the indoor expansion valve 140, to connect the main outdoor heat exchanger 131 and the indoor heat exchanger 120. The liquid branch line 176 may be branched from the liquid line 171, and connected to the sub outdoor heat exchanger 132. A capillary tube 178 to expand the refrigerant may be provided at or on the liquid branch line 176. The capillary tube 178 may expand the refrigerant discharged from the sub outdoor heat exchanger 132 or expand the refrigerant introduced into the sub outdoor heat exchanger 132. Alternatively, the capillary tube 178 may be replaced by an expansion valve.

The first gas line 172 may connect the indoor heat exchanger 120 and the switch 190. The first bypass line 174 may be branched from the first gas line 172, and may be connected to the sub outdoor heat exchanger 132. A first bypass valve 177 to adjust a flow of the refrigerant may be provided at or on the first bypass line 174. The first bypass valve 177 may be closed in the general cooling mode, high-load cooling mode, general heating mode, and high-load heating mode, and may be opened in the low-load cooling mode and low-load heating mode.

The second gas line 173 may connect the main outdoor heat exchanger 131 and the switch 190. The second bypass line 175 may be branched from the second gas line 173, and may be connected to the sub outdoor heat exchanger 132. A second bypass valve 179 to adjust a flow of the refrigerant may be provided at the second bypass line 175. The second bypass valve 179 may be closed in the general cooling mode, low-load cooling mode, general heating mode, and low-load heating mode, and may be opened in the high-load cooling mode and high-load heating mode.

An outdoor unit fan or outdoor fan 180 may be provided to cause outdoor air to flow such that the main outdoor heat exchanger 131 and/or the sub outdoor heat exchanger 132 exchanges heat with outdoor air. The outdoor fan 180 may be arranged at a side of the main outdoor heat exchanger 131 in order to cause outdoor air to flow to the main outdoor heat exchanger 131 after passing around the sub outdoor heat exchanger 132, and then to be discharged through the outdoor fan 180. In this embodiment, the sub outdoor heat exchanger 132 is arranged adjacent the main outdoor heat exchanger 131, and the outdoor fan 180 is arranged adjacent the main outdoor heat exchanger 131 in a flow direction of outdoor air. Alternatively, the sub outdoor heat exchanger 132 may be arranged adjacent the main outdoor heat exchanger 131 and the outdoor fan 180 over the main outdoor heat exchanger 131.

A controller 10 may be provided to control the compressor 110, the indoor expansion valve 140, the outdoor expansion valve 160, the switch 190, the first bypass valve 177, and the second bypass valve 179 in accordance with an operation mode and a cooling or heating load. In the general cooling mode, the controller 10 may control the switch 190 to connect the compressor 110 and the second gas line 173, and to connect the first gas line 172 and the gas-liquid separator 160, adjust the opening degree of the indoor expansion valve 140 for expansion of the refrigerant, completely open the outdoor expansion valve 150, control the compressor 110 to operate in a normal operation speed range, close the first bypass valve 177, and close the second bypass valve 179.

In the low-load cooling mode the controller 10 may control the switch 190 to connect the compressor 110 and the second gas line 173, and to connect the first gas line 172 and the gas-liquid separator 160, adjust the opening degree of the indoor expansion valve 140 for expansion of refrigerant, completely open the outdoor expansion valve 150, control the compressor 110 to operate at a minimum operation speed, open the first bypass valve 177, and close the second bypass valve 179. In the high-load cooling mode, the controller 10 may control the switch 190 to connect the compressor 110 and the second gas line 173, and to connect the first gas line 172 and the gas-liquid separator 160, adjust the opening degree of the indoor expansion valve 140 for expansion of refrigerant, completely open the outdoor expansion valve 150, control the compressor 110 to operate at a maximum operation speed, close the first bypass valve 177, and open the second bypass valve 179.

In the general heating mode, the controller 10 may control the switch 190 to connect the compressor 110 and the first gas line 172, and to connect the second gas line 173 and the gas-liquid separator 160, completely open the indoor expansion valve 140, adjust the opening degree of the outdoor expansion valve 150 for expansion of refrigerant, control the compressor 110 to operate in the normal operation speed range, close the first bypass valve 177, and close the second bypass valve 179. In the low-load heating mode, the controller 10 may control the switch 190 to connect the compressor 110 and the first gas line 172, and to connect the second gas line 173 and the gas-liquid separator 160, completely open the indoor expansion valve 140 adjust the opening degree of the outdoor expansion valve 150 for expansion of refrigerant, control the compressor 110 to operate at the minimum operation speed, open the first bypass valve 177, and close the second bypass valve 179. In the high-load heating mode, the controller 10 may control the switch 190 to connect the compressor 110 and the first gas line 172, and to connect the second gas line 173 and the gas-liquid separator 160 completely open the indoor expansion valve 140, adjust the opening degree of the outdoor expansion valve 150 for expansion of refrigerant, control the compressor 110 to operate at the maximum operation speed, close the first bypass valve 177, and open the second bypass valve 179.

In this embodiment, the operation mode of the air conditioner includes a general defrosting mode, a rear-portion defrosting mode, and a front-portion defrosting mode, in addition to the general cooling mode, the low-load cooling mode the high-load cooling mode, the general heating mode, the low-load heating mode, and the high-load heating mode. The defrosting modes are operation modes for removing frost from the main outdoor heat exchanger 131 and/or sub outdoor heat exchanger 132 through condensation of refrigerant. In the general defrosting mode, frost may be removed from the main outdoor heat exchanger 131 and the sub outdoor heat exchanger 132 through condensation of refrigerant. In the rear-portion defrosting mode, frost may be removed from the sub outdoor heat exchanger 132 through condensation of refrigerant. In the front-portion defrosting mode, frost may be removed from the main outdoor heat exchanger 131 through condensation of refrigerant.

A flow of the refrigerant in the general defrosting mode may be the same as a flow of the refrigerant in the high-load cooling mode. A flow of the refrigerant in the rear-portion defrosting mode may be the same as a flow of the refrigerant in the low-load heating mode. A flow of the refrigerant in the front-portion defrosting mode may be the same as a flow of the refrigerant in the low-load cooling mode. In the above-described and following descriptions, the high-load cooling mode corresponds to the general defrosting mode, the low-load heating mode corresponds to the rear-portion defrosting mode, and the low-load cooling mode corresponds to the front-portion defrosting mode.

Figure 3:
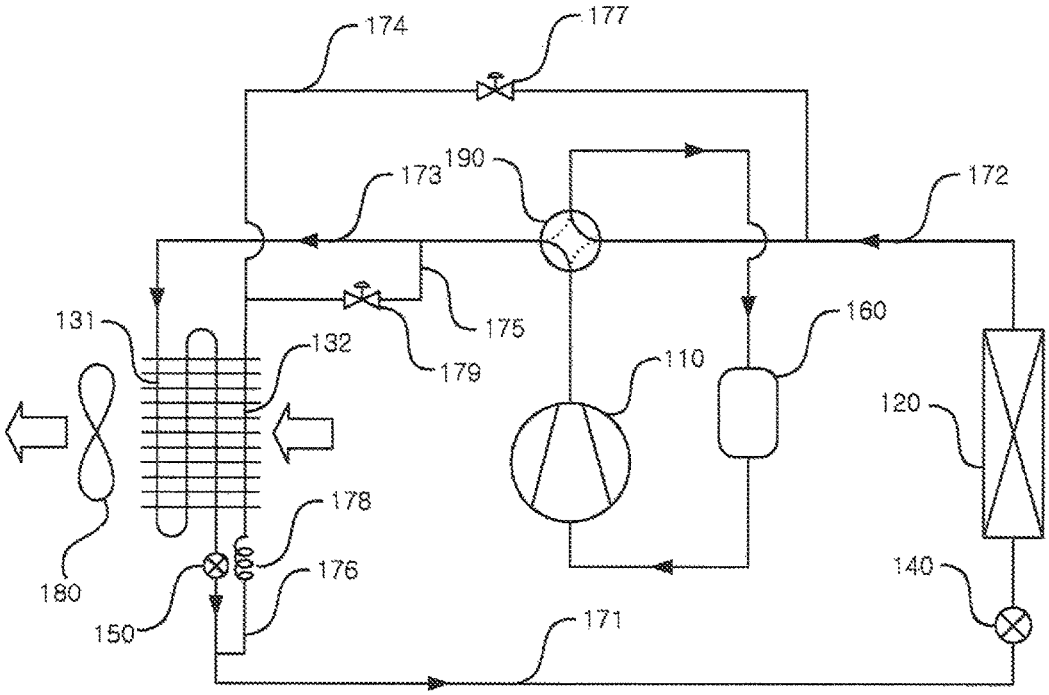
FIG. 3 is a schematic diagram illustrating a flow of refrigerant in a general cooling mode in the air conditioner of FIG. 1.

FIG. 3 is a schematic diagram illustrating a flow of refrigerant in the general cooling mode in the air conditioner of FIG. 1. In the general cooling mode, the refrigerant compressed in the compressor 110 may be fed to the switch 190. In the general cooling mode, the switch 190 may connect the compressor 110 and the second gas line 173. In this state, the second bypass valve 179 may be in a closed state and, as such, the refrigerant fed to the switch 190 may be fed to the main outdoor heat exchanger 131 via the second gas line 173.

The refrigerant fed to the main outdoor heat exchanger 131 may be condensed through heat exchange thereof with outdoor air. In the general cooling mode, the outdoor expansion valve 150 may be completely opened and as such, refrigerant condensed in the main outdoor heat exchanger 131 may be fed to the liquid line 171 via the outdoor expansion valve 150. In the general cooling mode, the first bypass valve 177 and the second bypass valve 179 may be closed, and as such, refrigerant fed to the liquid line 171 may be fed to the indoor expansion valve 140.

The refrigerant fed to the indoor expansion valve 140 may be expanded. The refrigerant expanded by the indoor expansion valve 140 may be fed to the indoor heat exchanger 120, and as such, may be evaporated through heat exchange thereof with indoor air. The refrigerant evaporated in the indoor heat exchanger 120 may be fed to the first gas line 172. In the general cooling mode, the first bypass valve 177 may be in a closed state, and as such, the refrigerant fed to the first gas line 172 may be fed to the switch 190.

In the general cooling mode, the switch 190 may connect the first gas line 172 and the gas-liquid separator 160. Accordingly, the refrigerant fed to the switch 190 may be separated into gas-phase refrigerant and liquid-phase refrigerant. The gas-phase refrigerant separated in the gas-liquid separator 160 may be introduced into the compressor 110, and as such, compressed.

Figure 4:
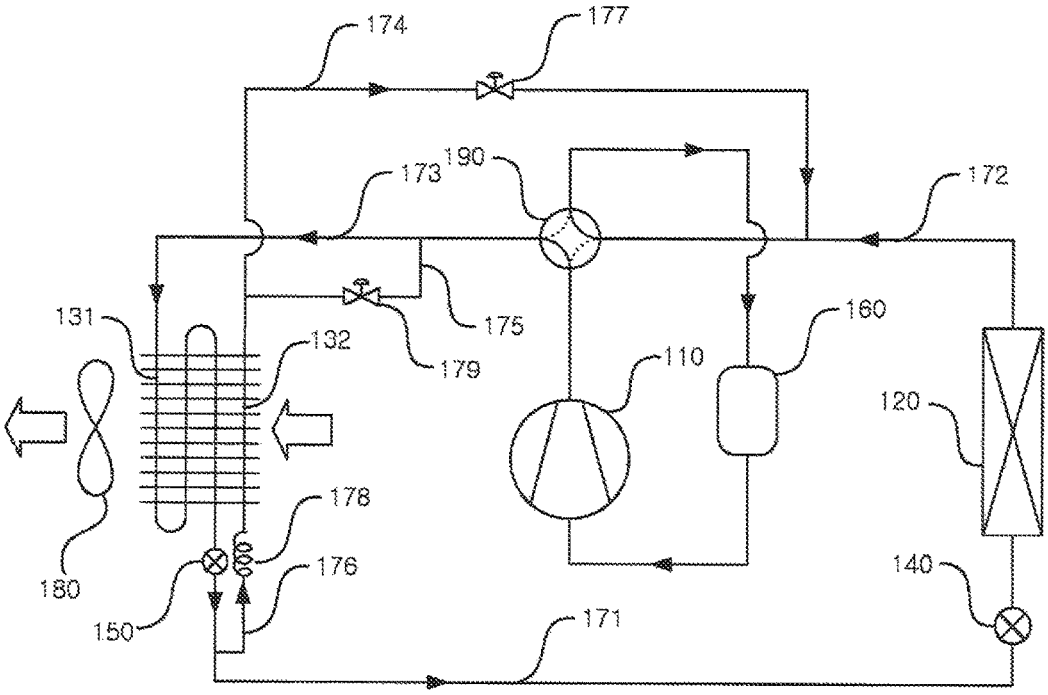
FIG. 4 is a schematic diagram illustrating a flow of refrigerant in a low-load cooling mode in the air conditioner of FIG. 1.

FIG. 4 is a schematic diagram illustrating a flow of refrigerant in the low-load cooling mode in the air conditioner of FIG. 1. In the low-load cooling mode, the refrigerant compressed in the compressor 110 is fed to the switch 190. In the low-load cooling mode, the switch 90 may connect the compressor 110 and the second gas line 173. In this state, the second bypass valve 179 may be in a closed state, and as such, refrigerant fed to the switch 190 may be fed to the main outdoor heat exchanger 131 via the second gas line 173.

The refrigerant fed to the main outdoor heat exchanger 131 may be condensed through heat exchange thereof with outdoor air. In the low-load cooling mode, the outdoor expansion valve 150 may be completely opened, and as such, refrigerant condensed in the main outdoor heat exchanger 131 may be fed to the liquid line 171 via the outdoor expansion valve 150. In the low-load cooling mode, the first bypass valve 177 may be opened, and as such, a portion of refrigerant fed to the liquid line 171 may be fed to the indoor expansion valve 140. A remaining portion of the refrigerant may be fed to the liquid branch line 176.

The refrigerant fed to the liquid branch line 176 may be expanded by the capillary tube 178, and may then be fed to the sub outdoor heat exchanger 132. The refrigerant fed to the sub outdoor heat exchanger 132 may be evaporated through heat exchanger thereof with outdoor air. In the low-load cooling mode, the second bypass valve 179 may be closed, and the first bypass valve 177 may be opened. Accordingly, the refrigerant evaporated in the sub outdoor heat exchanger 132 may be fed to the first bypass line 174.

The refrigerant fed to the indoor expansion valve 140 may be expanded. The refrigerant expanded by the indoor expansion valve 140 may be fed to the indoor heat exchanger 120, and as such, may be evaporated through heat exchange thereof with indoor air. The refrigerant evaporated in the indoor heat exchanger 120 may be fed to the first gas line 172. In the low-load cooling mode, the first bypass valve 177 may be in an open state, and as such, the refrigerant fed to the first gas line 172 may be fed to the switch 190 after being joined with refrigerant fed to the first bypass line 174.

In the low-load cooling mode, the switch 190 may connect the first gas line 172 and the gas-liquid separator 160. Accordingly, the refrigerant fed to the switch 190 may be separated into gas-phase refrigerant and liquid-phase refrigerant. The gas-phase refrigerant separated in the gas-liquid separator 160 may be introduced into the compressor 110, and as such, compressed.

The above description given of the low-load cooling mode may also be applied to the front-portion defrosting mode. In the front-portion defrosting mode, the main outdoor heat exchanger 131 may condense the refrigerant, thereby removing frost.

Figure 5:
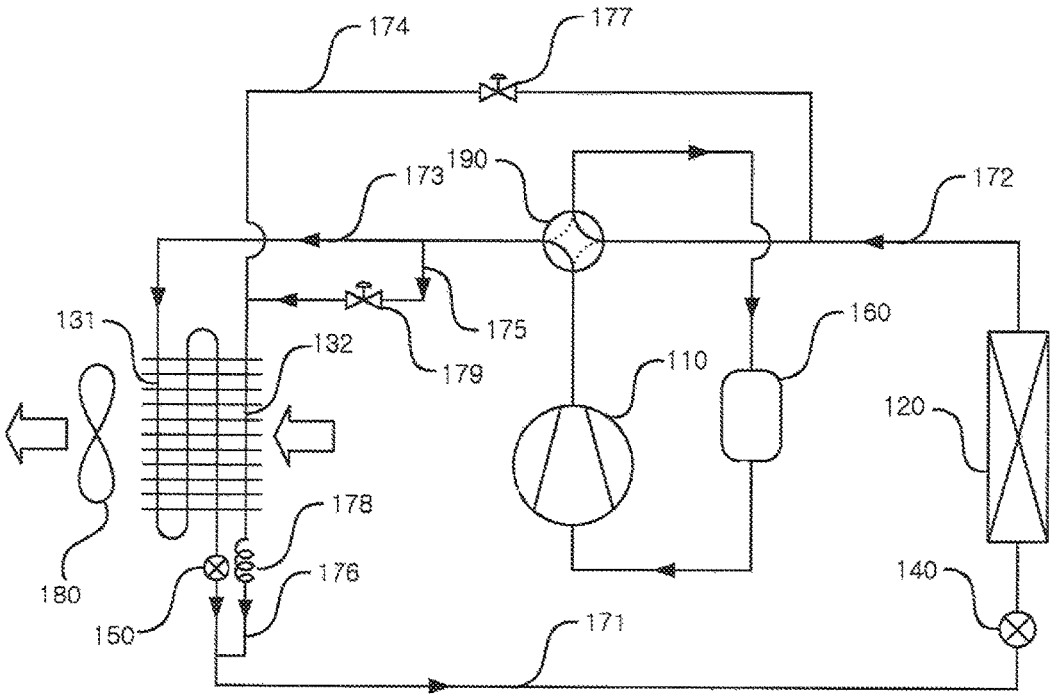
FIG. 5 is a schematic diagram illustrating a flow of refrigerant in a high-load cooling mode in the air conditioner of FIG. 1.

FIG. 5 is a schematic diagram illustrating a flow of refrigerant in the high-load cooling mode in the air conditioner of FIG. 1. In the high-load cooling mode, the refrigerant compressed in the compressor 110 may be fed to the switch 190. In the high-load cooling mode, the switch 190 may connect the compressor 110 and the second gas line 173, and as such, the refrigerant fed to the switch 190 may be fed to the second gas line 173. In the high-load cooling mode, the second bypass valve 179 may be opened, and as such, a portion of the refrigerant fed to the second gas line 173 may be fed to the main outdoor heat exchanger 131. A remaining portion of the refrigerant may be fed to the second bypass line 175.

In the high-load cooling mode, the first bypass valve 177 may be in a closed state, and as such, refrigerant fed to the second bypass line 175 may be fed to the sub outdoor heat exchanger 132. The refrigerant fed to the sub outdoor heat exchanger 132 may be condensed through heat exchange thereof with outdoor air. The refrigerant condensed in the sub outdoor heat exchanger 132 may be fed to the liquid branch line 176 after being expanded by the capillary tube 178.

The refrigerant fed to the main outdoor heat exchanger 131 may be condensed through heat exchange thereof with outdoor air. In the high-load cooling mode, the outdoor expansion valve 150 may be completely opened, and as such, the refrigerant condensed in the main outdoor heat exchanger 131 may be fed to the liquid line 171 after passing through the outdoor expansion valve 150. The refrigerant fed to the liquid line 171 may be fed to the indoor expansion valve 140 after being joined with refrigerant fed to the liquid branch line 176.

The refrigerant fed to the indoor expansion valve 140 may be expanded. The refrigerant expanded by the indoor expansion valve 140 may be fed to the indoor heat exchanger 120, and then may be evaporated through heat exchange thereof with indoor air. The refrigerant evaporated in the indoor heat exchanger 120 may be fed to the first gas line 172. In the high-load cooling mode, the first bypass valve 177 may be in a closed state, and as such, the refrigerant fed to the first gas line 172 may be fed to the switch 190.

In the high-load cooling mode, the switch 190 may connect the first gas line 172 and the gas-liquid separator 160, and as such, the refrigerant fed to the switch 190 may be fed to the gas-liquid separator 160. The refrigerant fed to the gas-liquid separator 160 may be separated into gas-phase refrigerant and liquid-phase refrigerant. The gas-phase refrigerant separated by the gas-liquid separator 160 may be introduced into the compressor 110, and as such, is compressed.

The above description given of the high-load cooling mode may also be applied to the general defrosting mode. In the general defrosting mode, the main outdoor heat exchanger 131 and the sub outdoor heat exchanger 132 may condense the refrigerant, thereby removing frost.

Figure 6:
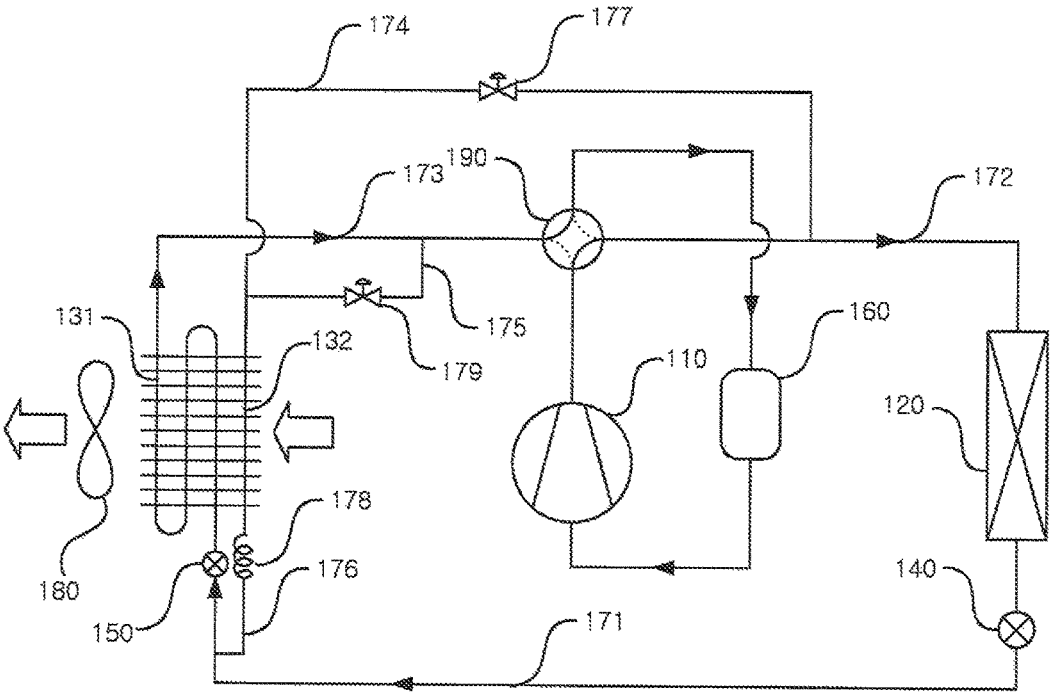
FIG. 6 is a schematic diagram illustrating a flow of refrigerant in a general heating mode in the air conditioner of FIG. 1.

FIG. 6 is a schematic diagram illustrating a flow of refrigerant in the general heating mode in the air conditioner of FIG. 1. In the general heating mode, the refrigerant compressed in the compressor 110 may be fed to the switch 190. In the general heating mode, the switch 190 may connect the compressor 110 and the first gas line 172. In this state, the second bypass valve 179 may be in a closed state, and as such, refrigerant fed to the switch 190 may be fed to the indoor heat exchanger 120 via the first gas line 172.

The refrigerant fed to the indoor heat exchanger 120 may be condensed through heat exchange thereof with indoor air. In the general heating mode, the indoor expansion valve 140 may be completely open, and as such, refrigerant condensed in the indoor heat exchanger 120 may be fed to the liquid line 171 via the indoor expansion valve 140. In the general heating mode, the first bypass valve 177 and the second bypass valve 179 may be closed, and as such, refrigerant fed to the liquid line 171 may be fed to the outdoor expansion valve 150.

The refrigerant fed to the outdoor expansion valve 150 may be expanded. The refrigerant expanded by the outdoor expansion valve 150 may be fed to the main outdoor heat exchanger 131, and as such, may be evaporated through heat exchange thereof with outdoor air. The refrigerant evaporated in the main outdoor heat exchanger 131 may be fed to the second gas line 173. In the general heating mode, the second bypass valve 179 may be in a closed state, and as such, the refrigerant fed to the second gas line 173 may be fed to the switch 190.

In the general heating mode, the switch 190 may connect the second gas line 173 and the gas-liquid separator 160. Accordingly, the refrigerant fed to the switch 190 may be separated into gas-phase refrigerant and liquid-phase refrigerant. The gas-phase refrigerant separated in the gas-liquid separator 160 may be introduced into the compressor 110, and as such, compressed.

Figure 7:
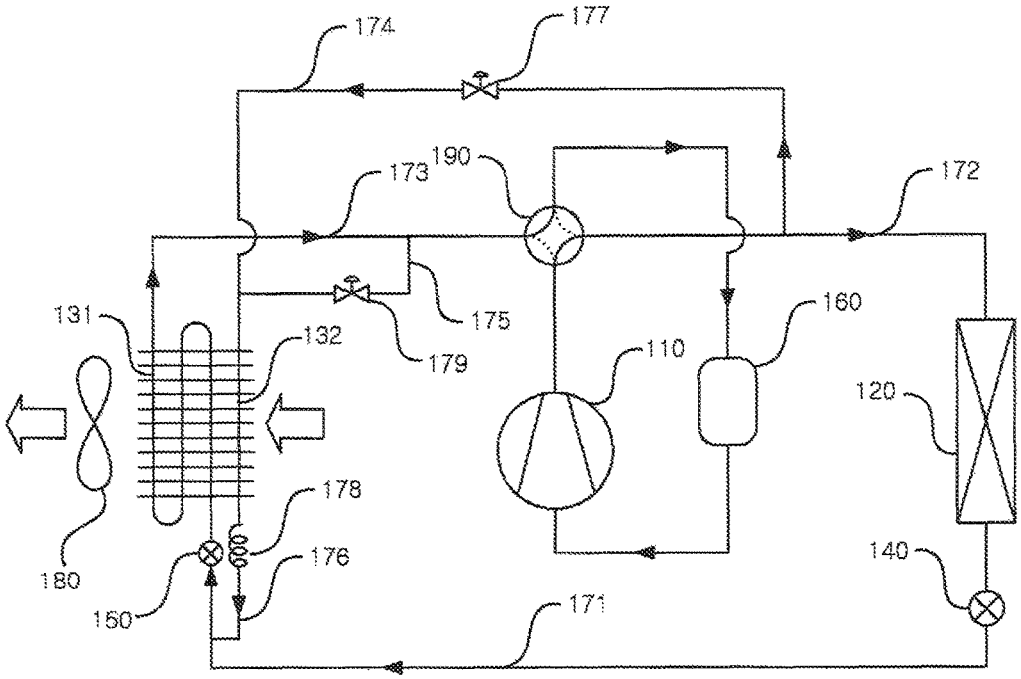
FIG. 7 is a schematic diagram illustrating flow of refrigerant in a low-load heating mode in the air conditioner of FIG. 1.

FIG. 7 is a schematic diagram illustrating, a flow of refrigerant in the low-load heating mode in the air conditioner of FIG. 1. In the low-load heating mode, refrigerant compressed in the compressor 110 may be fed to the switch 190. In the low-load heating mode, the switch 190 may connect the compressor 110 and the first gas line 172, and as such, the refrigerant fed to the switch 190 may be fed to the first gas line 172. In the low-load heating mode, the first bypass valve 177 may be opened, and as such, a portion of the refrigerant fed to the first gas line 172 may be fed to the indoor heat exchanger 120, and a remaining portion of the refrigerant may be fed to the first bypass line 174.

In the low-load heating mode, the second bypass valve 179 may be in a closed state, and as such, the refrigerant fed to the first bypass line 174 may be fed to the sub outdoor heat exchanger 132. The refrigerant fed to the sub outdoor heat exchanger 132 may be condensed through heat exchange thereof with outdoor air. The refrigerant condensed in the sub outdoor heat exchanger 132 may be fed to the liquid branch line 176 after being expanded by the capillary tube 178.

The refrigerant fed to the indoor heat exchanger 120 may be condensed through heat exchange thereof with indoor air in the low-load heating mode the indoor expansion valve 140 may be completely opened, and as such, the refrigerant condensed in the indoor heat exchanger 120 may be fed to the liquid line 171 via the indoor expansion valve 140. The refrigerant fed to the liquid branch line 176 may be fed to the outdoor expansion valve 150 after being joined with refrigerant fed to the liquid branch line 176.

The refrigerant fed to the indoor expansion valve 140 may be expanded. The refrigerant expanded by the indoor expansion valve 140 may be fed to the main outdoor heat exchanger 131, and as such, may be evaporated through heat exchange thereof with outdoor air. The refrigerant evaporated in the main outdoor heat exchanger 131 may be fed to the second gas line 173. In the low-load heating mode, the second bypass valve 179 may be in a closed state, and as such, the refrigerant fed to the second gas line 173 may be fed to the switch 190.

In the low-load heating mode, the switch 190 may connect the second gas line 173 and the gas-liquid separator 160. Accordingly, the refrigerant fed to the switch 190 may be separated into gas-phase refrigerant and liquid-phase refrigerant. The gas-phase refrigerant separated in the gas-liquid separator 160 may be introduced into the compressor 110, and as such, compressed.

In the low-load heating mode, the sub outdoor heat exchanger 132 may condense the refrigerant, thereby heating outdoor air. The main outdoor heat exchanger 131 may exchange heat with outdoor air heated by the sub outdoor heat exchanger 132, and as such, heating performance and efficiency may be enhanced.

The above description given of the low-load heating mode may also be applied to the rear-portion defrosting mode. In the rear-portion defrosting mode, the sub outdoor heat exchanger 132 may condense the refrigerant, thereby removing frost. In the rear-portion defrosting mode, the indoor heat exchanger 120 may condense the refrigerant, thereby heating indoor air. Accordingly, continuous heating may be achieved.

Figure 8:
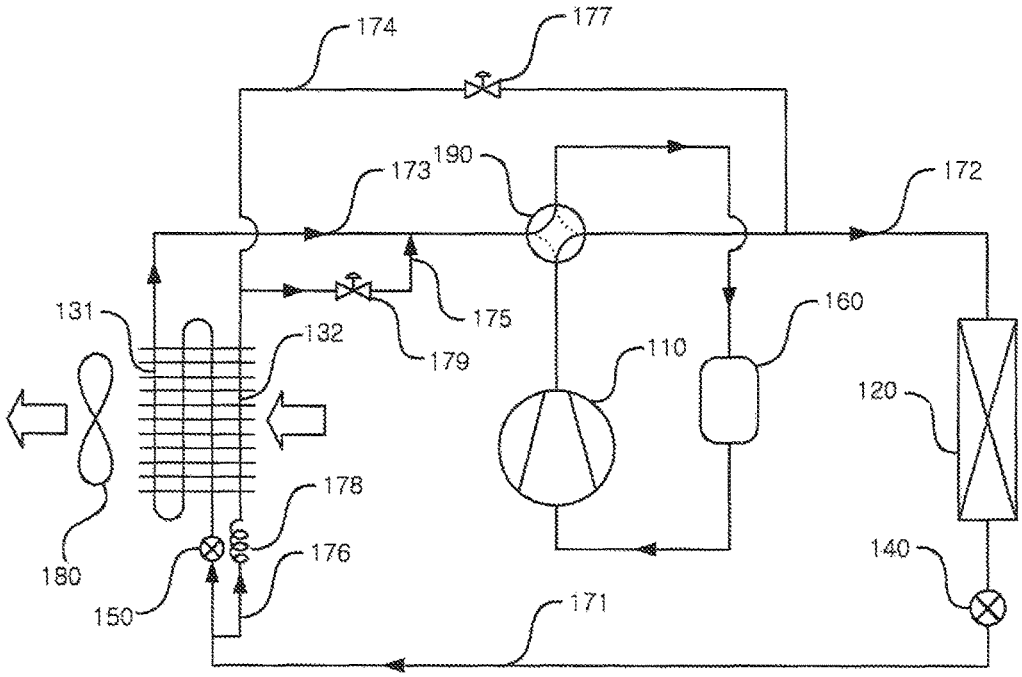
FIG. 8 is a schematic diagram illustrating a flow of refrigerant in a high-load heating mode in the air conditioner of FIG. 1.

FIG. 8 is a schematic diagram illustrating flow of refrigerant in the high-load heating mode in the air conditioner of FIG. 1. In the high-load heating mode, refrigerant compressed in the compressor 110 may be fed to the switch 190. In the high-load heating mode, the switch 190 may connect the compressor 110 and the first gas line 172. In this state, the first bypass valve 177 may be in a closed state, and as such, refrigerant fed to the switch 190 may be fed to the indoor heat exchanger 120 via the first gas line 172.

The refrigerant fed to the indoor heat exchanger 120 may be condensed through heat exchange thereof with indoor air. In the high-load heating mode, the indoor expansion valve 140 may be completely open, and as such, refrigerant condensed in the indoor heat exchanger 120 is fed to the liquid line 171 via the indoor expansion valve 140.

In the high-load heating mode, the first bypass valve 177 may be closed, and the second bypass valve 179 may be opened, and as such, a portion of the refrigerant fed to the liquid line 171 may be fed to the outdoor expansion valve 150, and a remaining portion of the refrigerant may be fed to the liquid branch line 176. The refrigerant fed to the liquid branch line 176 may be expanded by the capillary tube 178, and then fed to the sub outdoor heat exchanger 132. The refrigerant fed to the sub outdoor heat exchanger 132 may be evaporated through heat exchanger thereof with outdoor air. In the high-load heating mode, the first bypass valve 177 may be closed, and the second bypass valve 179 opened. Accordingly, the refrigerant evaporated in the sub outdoor heat exchanger 132 may be fed to the second bypass line 175.

The refrigerant fed to the outdoor expansion valve 150 may be expanded. The refrigerant expanded by the outdoor expansion valve 150 may be fed to the main outdoor heat exchanger 131, and as such, evaporated through heat exchange thereof with outdoor air. The refrigerant evaporated in the main outdoor heat exchanger 131 may be fed to the second gas line 173. The refrigerant fed to the second gas line 173 may be fed to the switch 190 after being joined with the refrigerant fed to the second bypass line 175.

In the high-load heating mode, the switch 190 connects the second gas line 173 and the gas-liquid separator 160. Accordingly, the refrigerant fed to the switch 190 may be fed to the gas-liquid separator 160. The refrigerant fed to the gas-liquid separator 160 may be separated into gas-phase, refrigerant and liquid-phase refrigerant. The gas-phase refrigerant separated in the gas-liquid separator 160 may be introduced into the compressor 110, and as such, compressed.

In accordance with an air conditioner according to embodiments disclosed herein, at least the following advantages are provided.

First, there is an advantage in that the outdoor heat exchanger is divided into two or more outdoor heat exchangers, and as such, may operate even in a low-load cooling or heating mode. Second, all of the divided outdoor heat exchangers may be operated for a maximum load, and as such, an enhancement in efficiency may be achieved.

Third, refrigerant bypassed to cope with a minimum load may be controlled through a normal cycle, and as such, the cycle may be stabilized, and an enhancement in reliability may be achieved. Fourth, there may be an advantage in that, in a heating mode for a minimum load, refrigerant may be condensed in a portion of the outdoor heat exchanger, and as such, an enhancement in efficiency may be achieved. Fifth, there may be an advantage in that a defrosting mode may be carried out in various manners.

Effects of the embodiments are not limited to the above-described effects. Other effects not yet described may be clearly understood by those skilled in the art from the accompanying claims.

Embodiments have been made in view of the above problems associated with the related art, and provide an air conditioner operable even in a low-load cooling or heating.

Embodiments disclosed herein provide an air conditioner capable of achieving maintenance of a stable cycle even in a low-load mode.

Embodiments disclosed herein provide an air conditioner that may include a compressor that compresses refrigerant, a main outdoor heat exchanger installed or provided in an outdoor space, that condenses refrigerant in a cooling mode and that evaporates refrigerant in a heating mode, an indoor heat exchanger installed or provided in an indoor space, that evaporates refrigerant in the cooling mode and that condenses refrigerant in the heating mode, a switching unit or switch that guides the refrigerant discharged from the compressor to the main outdoor heat exchanger in the cooling mode and that guides the refrigerant discharged from the compressor to the indoor heat exchanger in the heating mode, and a sub outdoor heat exchanger that evaporates a portion of refrigerant condensed in the main outdoor heat exchanger in a low-load cooling mode and that condenses a portion of the refrigerant discharged from the compressor in a low-load heating mode.

Embodiments disclosed herein further provide an air conditioner that may include a compressor that compresses refrigerant, a main outdoor heat exchanger installed or provided in an outdoor space, to perform heat exchange between outdoor air and refrigerant, an indoor heat exchanger installed or provided in an indoor space, to perform heat exchange between indoor air and refrigerant, a switching unit or switch that guides the refrigerant discharged from the compressor to the main outdoor heat exchanger in a cooling mode and that guides the refrigerant discharged from the compressor to the indoor heat exchanger in a heating mode, and a sub outdoor heat exchanger connected, at one or a first end thereof, between the main outdoor heat exchanger and the indoor heat exchanger and connected, at the other or a second end thereof, between the switching unit and the indoor heat exchanger, to perform heat exchange between outdoor air and refrigerant.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a compressor that compresses refrigerant;

a main outdoor heat exchanger provided in an indoor space and configured to exchange heat between indoor air and the refrigerant;

an indoor heat exchanger provided in an indoor space and configured to exchange heat between indoor air and the refrigerant;

a switch configured to guide the refrigerant discharged from the compressor to the main outdoor heat exchanger in a cooling mode and configured to guide the refrigerant discharged from the compressor to the indoor heat exchanger in a heating mode;

a liquid line that connects the main outdoor heat exchanger and the indoor heat exchanger;

a first gas line that connects the indoor heat exchanger and the switch;

a second gas line that connects the main outdoor heat exchange and the switch;

an auxiliary outdoor heat exchanger having a first end connected to the liquid line between the main outdoor heat exchanger and the indoor heat exchanger and having a second end connected to the first gas line between the switch and the indoor heat exchanger, the auxiliary outdoor heat exchanger being configured to exchange heat between the outdoor air and the refrigerant;

a liquid branch line branched from the liquid line and connected to the first end of the auxiliary outdoor heat exchanger;

a first bypass line branched from the first gas line and connected to the second end of the auxiliary outdoor heat exchanger;

a first bypass valve provided at the first bypass line to adjust a flow of refrigerant;

an outdoor expansion valve connected to the main outdoor heat exchanger and liquid line;

a capillary tube provided at the liquid branch line to expand refrigerant; and a controller configured to:

open the first bypass valve in a low-load cooling mode and a low-load heating mode;

close the first bypass valve in a general cooling mode, a general heating mode, ad high-load cooling mode, and a high-load heating mode;

open the second bypass valve in the high-load cooling mode and the high-load heating mode; and close the second bypass valve in the general cooling mode, the low-load cooling mode, the general heating mode, and the low-load heating mode.

2. The air conditioner of claim 1, further comprising an outdoor fan configured to draw air over the auxiliary outdoor heat exchanger and the main outdoor heat exchanger in succession.

* * * * *